US005823806A

United States Patent [19]

Nagase et al.

[11] Patent Number: 5,823,806

[45] Date of Patent: Oct. 20, 1998

[54] LAMP SOCKET

[75] Inventors: Haruo Nagase, Kitakatsuragi-gun; Masaaki Ichikawa, Tsuzuki-gun; Hideki Hamada, Katano; Nobuo Kato, Settsu; Tomoyuki Ono, Soraku-gun; Yasuhiro Kimura, Agatsuma-gun, all of Japan

[73] Assignee: Matsushita Electric Works, Ltd., Osaka, Japan

[21] Appl. No.: 722,157

[22] PCT Filed: Feb. 19, 1996

[86] PCT No.: PCT/JP96/00365

§ 371 Date: Dec. 19, 1996

§ 102(e) Date: Dec. 19, 1996

[87] PCT Pub. No.: WO96/26559

PCT Pub. Date: Aug. 29, 1996

[30] Foreign Application Priority Data

Feb. 22, 1995 [JP] Japan ..... 7-033246
Feb. 24, 1995 [JP] Japan ..... 7-037196

[51] Int. Cl.[6] ..... H01R 13/44

[52] U.S. Cl. ..... 439/140; 439/336

[58] Field of Search ..... 439/140, 141, 439/336, 671, 672

[56] References Cited

U.S. PATENT DOCUMENTS 3,387,255 6/1968 Earleywine ..... 439/672

FOREIGN PATENT DOCUMENTS 53-55976 5/1978 Japan .
55-109384 8/1980 Japan .
56-97979 8/1981 Japan .
61-162981 10/1986 Japan .
6-76902 3/1994 Japan .
6-38190 5/1994 Japan .

OTHER PUBLICATIONS

An English Language Abstract of JP 53–55976.
An English Language Abstract of JP 56–97979.
An English Language Abstract of JP 6–38190.
An English Language Abstract of JP 6–76902.
An English Language Abstract of JP 55–109384.
An English Language Abstract of JP 61–162981.

*Primary Examiner*—Neil Abrams
*Assistant Examiner*—T. C. Patel
*Attorney, Agent, or Firm*—Greenblum & Bernstein P.L.C.

[57] ABSTRACT

A lamp socket for supporting an HID lamp includes a hollow casing having a lamp mounting opening defined at one end and the opposite end closed;

an electrode carrier member disposed inside the casing; a center electrode disposedon the electrode carrier member at a location coaxial with an axis perpendicular to a plane of the lamp mounting opening and engageable with a center contact point in a mouthpiece of a lamp to be received in the lamp socket; a peripheral electrode disposed on the electrode carrier member at a location offset laterally from the center electrode and also from the axis for engagement a peripheral contact point in the mouthpiece of the lamp; an electrode shielding member disposed within the casing for movement between projected and retracted positions; and a coil spring for biasing the electrode shielding member to the projected position and operable to permit the electrode shielding member to move towards the retracted position against a biasing force thereof in response to insertion of the lamp mouthpiece into the lamp mounting opening. The electrode shielding member when in the retracted position permits the center and peripheral electrodes to be electrically engaged with the center and peripheral contact points in the lamp mouthpiece when the electrode shielding member is moved to the retracted position, but the electrode shielding member when in the projected position substantially conceals the center and peripheral electrodes.

18 Claims, 10 Drawing Sheets

Fig. 15
PRIOR ART
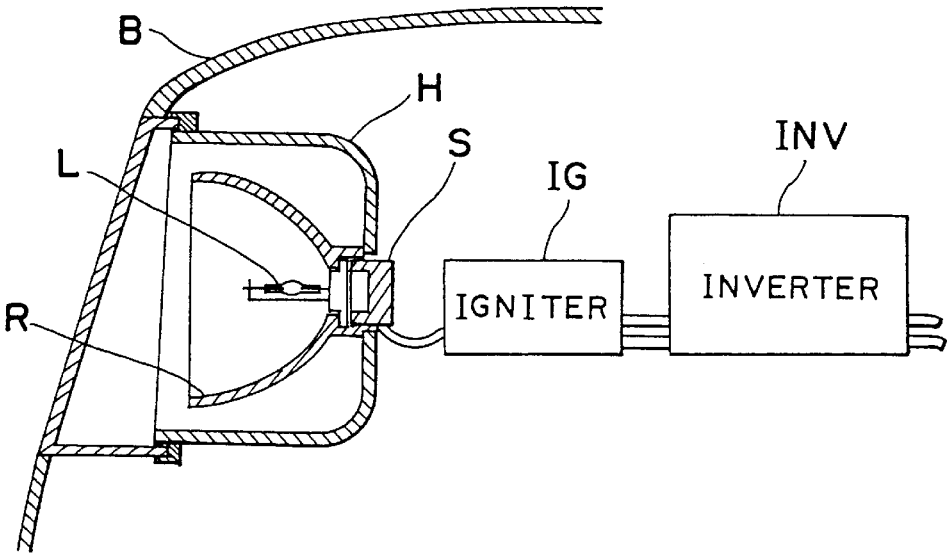
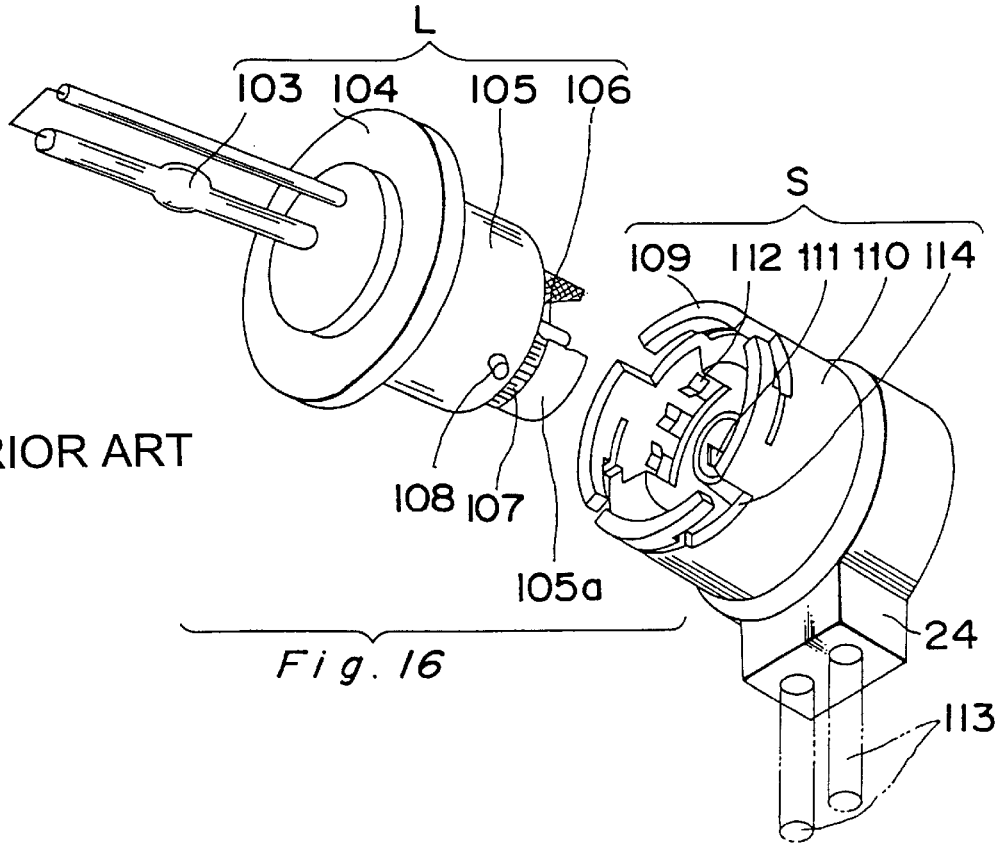
PRIOR ART
Fig. 16

LAMP SOCKET

(FIELD OF THE INVENTION)

The present invention relates to a lamp socket for lighting bulbs such as, for example, automobile headlight lamps or projector lamps in industrial equipments.

(DESCRIPTION OF THE PRIOR ART)

To illuminate a target a substantial distance away from the source of light, a high-intensity lamp capable of emitting a high-radiant beam is generally employed. A halogen lamp is generally well known one of high-intensity lamps, but a high intensity discharge (HID) lamp is now developed over the world. As compared with the halogen lamp, the HID lamp is effective to provide a high illumination and also to accomplish an energy saving.

However, the HID lamp requires the use of an illumination control circuit including a voltage stabilizer and an ignitor for applying a high voltage to the lamp to initiate discharge within the lamp envelope when the lamp is desired to be turned on. In view of the necessity of application of the high voltage to the HID lamp, the lamp socket for use with the HID lamp must have a substantial electrical insulation.

When it comes to automobile headlights, lamps therefor must be of a type capable of emitting a high-radiant beam so that an area of the road surface spaced a substantial distance away from the automobile in consideration of the braking distance can be illuminated. Attempts have been made to use the HID lamp in an automobile headlights, an example of which is shown in FIGS. 15 to 17. FIG. 15 is a schematic side sectional representation of one automobile headlight system including a headlight housings H formed in front left and right portions of an automobile front body structure and below a bonnet B. The headlight housing H includes a generally bowl-shaped reflector R opening forwardly of the automobile front body structure and a lamp holder or socket S installed at the bottom of the reflector R opposite to the opening thereof. The lamp socket S has electrodes electrically connected with an electric power source through an ignitor IG and an invertor INV.

The details of the lamp socket S shown in FIG. 15 and the HID lamp L ready to be mounted in the lamp socket S are best shown in FIG. 16. As shown therein, the HID lamp L includes a light emitting tube 103, a generally cylindrical mouthpiece 105 formed integrally with a radially outwardly extending collar 104 adjacent the light emitting tube 103, a center contact point 106 extending coaxially outwardly from the end of the mouthpiece 105 remote from the collar 104 and surrounded by a cylindrical protective skirt 105*a*, a peripheral contact point 107 formed on the mouthpiece 105 so as to encircle the center contact point 106, and at least two bayonet mounting pins 108 protruding radially outwardly from the mouthpiece 105. This type of HID lamp is well known in the art.

The lamp socket S is so designed as to receive and support the HID lamp L when the HID lamp L is mounted with the mouthpiece 105 oriented towards it. For this purpose, the known lamp socket S includes, as shown in FIGS. 16 and 17, a generally cylindrical casing 110 having a lamp mounting opening 109 defined at one end and also having the opposite end closed by an end wall. The interior of the casing 110 communicated with the lamp mounting opening 109 has accommodated therein a center electrode 111 and a peripheral electrode 112 are arranged for electric connection with the center contact point 106 and the peripheral contact point 107, respectively. A cylindrical end wall of the casing 110 adjacent the lamp mounting opening 109 is formed with at least one pair of bayonet mounting grooves 114 of a generally L-shaped configuration defined therein, although in FIG. 16 two pairs of the grooves 114 are shown. These bayonet mounting grooves 114 are used to receive the corresponding bayonet mounting pins 108 rigid with the mouthpiece 105 when the HID lamp L is mounted in the lamp socket S with the mouthpiece 105 inserted into the lamp mounting opening 109. Reference numeral 113 represents lead lines utilized to connect the center electrode 111 and the peripheral electrode 112 with the igniter IG, which lines extend outwardly from the lamp socket S through a line retainer box 24 integral with the casing 110.

In this known lamp socket S, when the lamp L is mounted in the socket S with the mouthpiece 105 inserted into the opening 109 of the casing 110 and is then turned an angle relative to the casing 110 with the pins 108 engaged in the respective grooves 114, mounting of the lamp L in the socket S completes. At this time, the center and peripheral contact points 106 and 107 of the lamp L are electrically connected with the center and peripheral electrodes 111 and 112 in the casing 110, respectively so that an electric power can be supplied to the lamp L.

When it comes to replacement of a burned lamp in an automobile headlight system, the burned lamp is generally replaced with a fresh lamp while the power source is switched off. After the replacement, the power source must be switched on for the driver or repairman to ascertain if the new lamp is working well. It may happen that, in the event that with the power source having been switched on the newly replaced lamp fails to work, i.e., fails to be lit, by some reason, the driver or repairman may work on the lamp and/or the lamp socket without knowing or being conscious of the power source having been switched on.

Turning now to the known lamp socket discussed hereinbefore, the center and peripheral electrodes are exposed to the outside through the opening in the casing at all times unless the lamp is mounted. Accordingly, ingress of metallic pieces into the socket through the lamp mounting opening while the power source is switched on may result in a hazardous condition such as, for example, electrical grounding and/or shortcircuitting. Considering that in the case of the HID lamp the ignitor is utilized to generate a high voltage necessary to ignite the lamp, there is a risk of electric shock which would occur when the lamp is worked on during generation of the high voltage and/or of shortcircuitting which would occur as a result of internal electric discharge within the lamp socket. These problems cannot be indeed ignored.

Specifically, in the case of the HID lamp, the high voltage pulse is applied when the lamp is desired to be turned on. Accordingly, if the ignitor is switched on while the lamp has not yet been mounted in the lamp socket, electric discharge is prone to occur between the electrodes. Once the electric discharge takes place, materials used to form the known lamp socket may be burned, fused and/or fired.

DISCLOSURE OF THE INVENTION

Therefore, the present invention has been devised to substantially eliminate the above discussed problems and disadvantages inherent in the prior art lamp socket and is intended to provide an improved lamp socket designed to secure a high safety factor even though fingers gain access into the lamp mounting opening.

Another important object of the present invention is to provide an improved lamp socket of the type referred to above, designed to minimize or substantially eliminate the generation of an electric spark between the electrodes within the lamp socket to thereby eliminate the possible burn, fusion and/or firing of the materials used to form the lamp socket.

These and other objects and features of the present invention can be accomplished by designing the lamp socket to comprise:

a hollow casing having a lamp mounting opening defined at one end and the opposite end closed;

an electrode carrier member disposed inside the casing;

a center electrode means disposed on the electrode carrier member at a location coaxial with an axis perpendicular to a plane of the lamp mounting opening, said center electrode being engageable with a center contact point in a mouthpiece of a lamp to be received in the lamp socket;

a peripheral electrode means disposed on the electrode carrier member at a location offset laterally from the center electrode and also from the axis, the peripheral electrode means being engageable with a peripheral contact point in the mouthpiece of the lamp;

an electrode shielding means disposed within the casing for movement between projected and retracted positions;

a biasing means for biasing the electrode shielding means to the projected position, the biasing means being operable to permit the electrode shielding means to move towards the retracted position against a biasing force thereof in response to insertion of the mouthpiece of the lamp into the lamp mounting opening; and the electrode shielding means when in the retracted position permitting the center and peripheral electrode means to be electrically engaged with the center and peripheral contact points in the mouthpiece of the lamp when the electrode shielding means is moved to the retracted position, but the electrode shielding means when in the projected position substantially concealing the center and peripheral electrode means.

The electrode shielding means referred to above is preferably in the form of an insert element made of an electrically insulating material and accommodated within the casing for movement between the projected and retracted positions such that when the insert element is in the projected position, the insert element surrounds at least the center electrode to conceal the latter. In such case, the insert element assume a position generally intermediate between the center and peripheral electrode means, when it is in the projected position, to advantageously minimize the possibility of an electric discharge which would otherwise take place between the center and peripheral electrode means.

Alternatively, the electrode shielding means may comprise an annular end plate accommodated within the casing for movement between the projected and retracted position and formed with respective perforations for passage of the center and peripheral electrode means during the movement of the annular end plate between the projected and retracted positions. This annular end plate when in the projected position closes the lamp mounting opening with the center and peripheral electrode means consequently concealed within the casing. In such case, the center electrode means may be surrounded by a tubular barrier made of an electrically insulating material and is capable of passing through a center hole of the annular end plate during the movement of the annular end plate between the projected and retracted positions.

Where the electrode carrier member is alternatively employed in the form of a sheath made of an electrically insulating material and accommodating therein the center electrode means so that the sheath can form a part of the electrode shielding means, any possible occurrence of an electric discharge between the center and peripheral electrode means can be advantageously suppressed.

The insert element referred to above may comprises a sleeve accommodating therein the sheath so as to permit the sheath to be movable in a direction parallel to a longitudinal axis of the casing, and an annular skirt surrounding one end of the sleeve adjacent the electrode carrier member and, on the other hand, the biasing means is preferably interposed between the electrode carrier member and a gap between the annular skirt and the sleeve. In such case, double walls defined respectively by the annular skirt and the sleeve are available between the center electrode means and the peripheral electrode means and, therefore, the possible occurrence of the electric discharge can further be suppressed.

Where the center electrode means and the peripheral electrode means are disposed in line with each other in a direction radially of the casing, the lamp can be firmly retained by the lamp socket with no possibility of the center and peripheral electrodes being separated from each other.

According to the present invention, so long as the lamp has not yet mounted in the lamp socket, the insulating insert element is held in the projected position protruding towards the lamp mounting opening, making it difficult for fingers to gain access to the center electrode means. This accounts for minimization of the possibility of occurrence of an electric shock. Also, since with the insulating insert element held in the projected position, double walls intervene between the center electrode means and the peripheral electrode means, the possibility is also minimized of an electric discharge which would occur between those electrode means when a high voltage pulse is applied thereto, consequently resulting in minimization of occurrence of any possible accident such as smoking and/firing of component parts of the lamp socket.

The use of a coil spring for the biasing means makes it possible for the insulating insert element to be positively urged towards the projected position and, therefore, a firm electric contact between the center contact point of the lamp with the center electrode means is ensured so long as the lamp is mounted in the lamp socket.

BRIEF DESCRIPTION OF THE DRAWINGS

FIG. 15 is a schematic side sectional view showing the HID lamp employed in an automobile headlight in an automobile front body structure;

FIG. 16 is a perspective view showing the prior art lamp socket in combination with the HID lamp ready to be received therein.

BEST MODE FOR CARRYING OUT THE INVENTION

Figure 1:
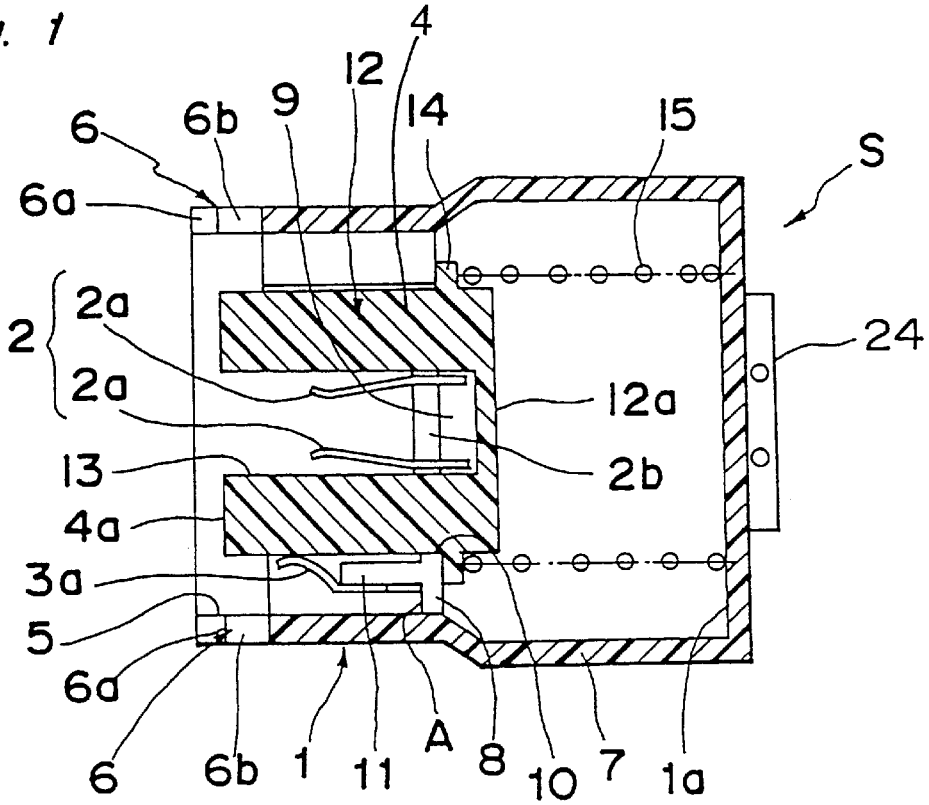
FIG. 1 is a schematic longitudinal sectional view of a lamp socket according to a first preferred embodiment of the present invention.

The present invention will become clear from the following description taken in conjunction with some preferred embodiments thereof with reference to the accompanying drawings in which like parts are designated by like reference numerals.

(First Embodiment)

Figure 2:
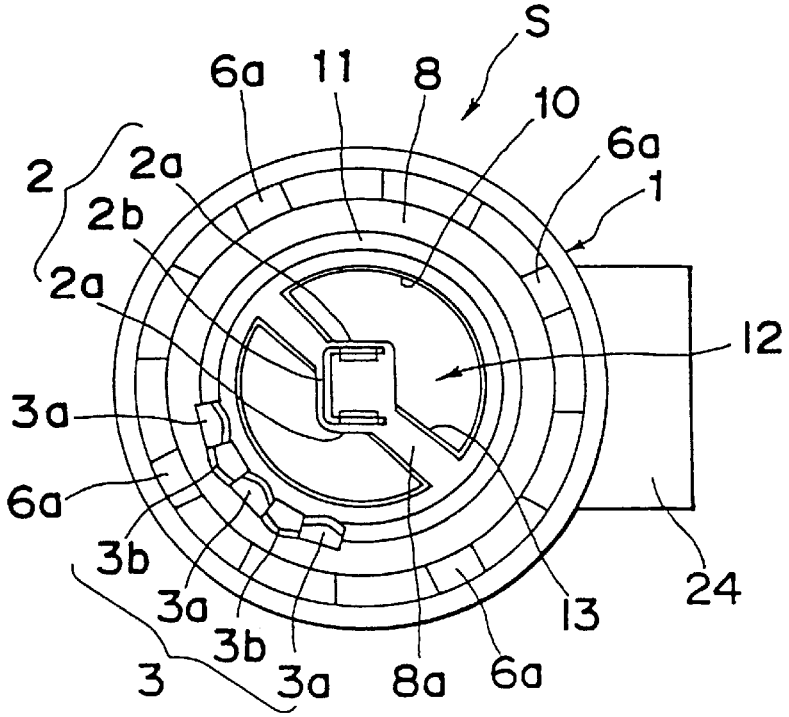
FIG. 2 is a front end view of the lamp socket shown in FIG. 1.
Figure 7:
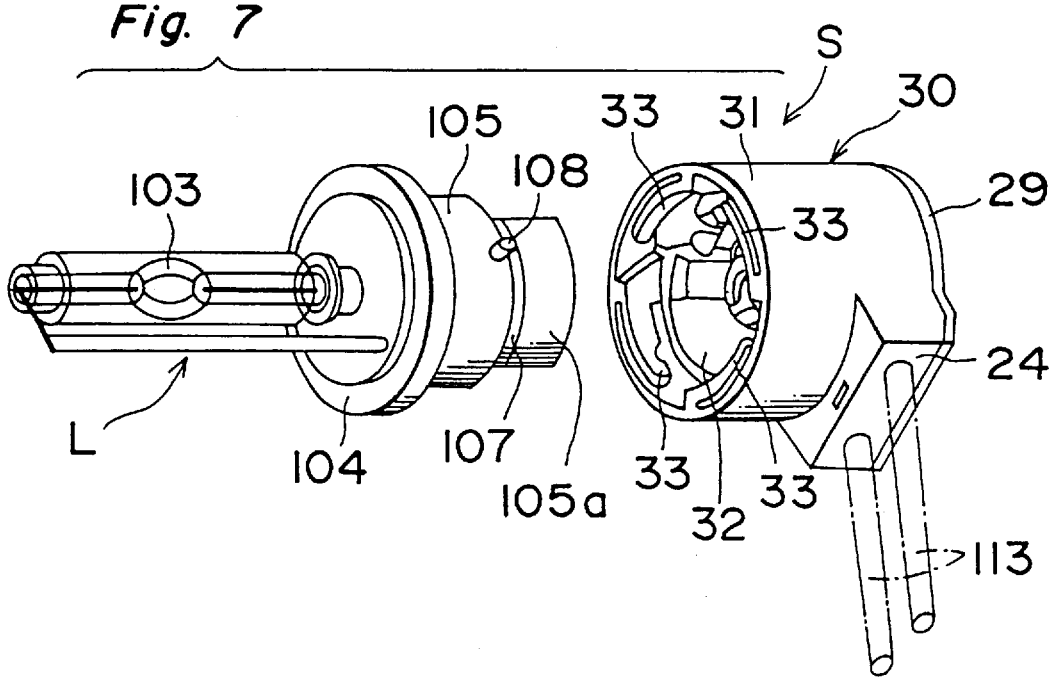
FIG. 7 is a perspective view showing the lamp socket according to a third preferred embodiment of the present invention in combination with an HID lamp ready to be received therein.
Figure 17:
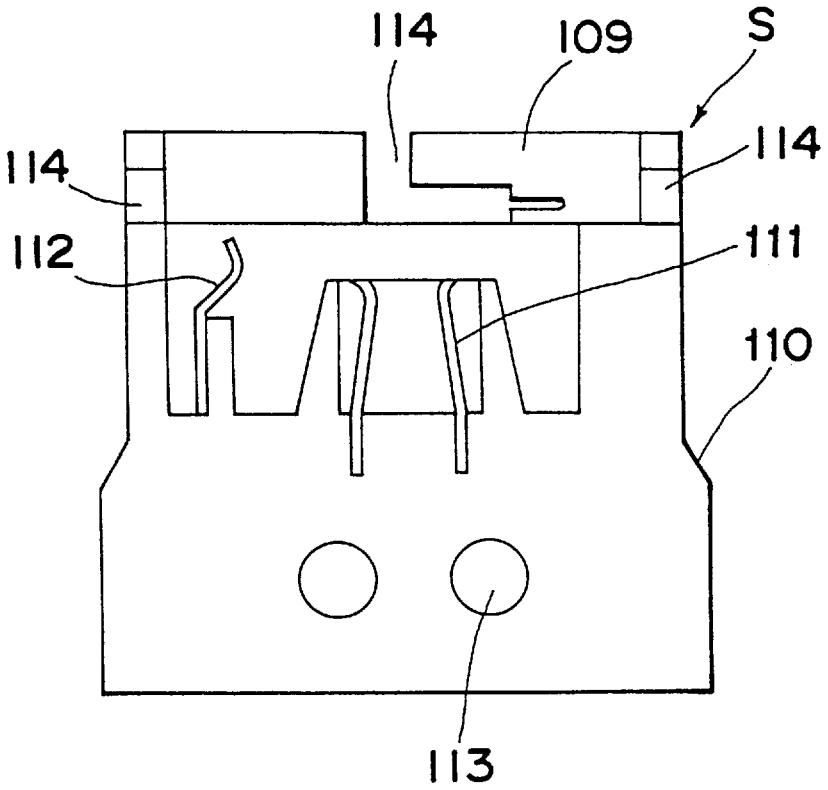
Fig. 17 PRIOR ART
FIG. 17 is a schematic side sectional view of the prior art lamp socket shown in FIG. 16.

A lamp socket S according to a first preferred embodiment of the present invention is shown in FIGS. 1 and 2. The illustrated lamp socket S comprises a generally cylindrical casing 1 made of hard plastic material, a center electrode 2 engageable with the center contact point 106 of the HID lamp L (FIG. 16), a peripheral electrode 3 engageable with the peripheral contact point 107 of the lamp L, and an electrode shielding means 4. The cylindrical casing 1 is of a shape substantially similar to that employed in the prior art lamp socket shown in FIGS. 16 and 17 and has first and second ends opposite to each other. The second end of the casing 1 represents an enlarged end 7 having a diameter greater than that of the first end and is closed by an end wall 1*a*. The enlarged end 7 is integrally formed with a line retainer box 24 so as to protrude radially outwardly, said line retainer box 24 accommodating therein a plurality of lead lines (shown by 113 in FIGS. 7 and 16) used for connection of the center and peripheral electrodes 2 and 3 with an electric power supply.

The first end of the cylindrical casing 1 has a lamp mounting opening 5 defined therein for receiving the mouthpiece 105 of the lamp L when the latter is mounted onto the lamp socket and delimited by a cylindrical end wall formed with at least one pair (two pairs being shown in the illustrated embodiment) of generally L-shaped bayonet mounting grooves 6. Each L-shaped bayonet mounting groove 6 includes an axial groove portion 6*a* and a circumferential groove portion 6*b* perpendicular to the axial groove portion 6*a* and extending a distance circumferentially of the first end of the casing 1. These L-shaped bayonet mounting grooves 6 are spaced circumferentially from each other for receiving the corresponding bayonet mounting pins 108 on the lamp mouthpiece 105 in a manner known to those skilled in the art.

The casing 1 has an annular partition plate 8 positioned generally intermediate between the first and second ends thereof and formed integrally therewith so as to extend radially inwardly, said annular partition plate 8 having a center hole 10 defined therein. This annular partition plate 8 is integrally formed with a cylindrical support wall 11 so as to protrude towards the lamp mounting opening 5 in a coaxial relation with the center hole 10 and is also integrally formed with a radial rib 8*a* so as to traverse the center hole 10 for the support of the center electrode 2 as best shown in FIG. 2.

In the illustrated embodiment, the center electrode 2 is of one-piece construction formed by the use of a metal press work and includes, for example, two center electrode pieces 2*a* connected at one end together by means of a connecting piece 2*b* This center electrode 2 is mounted fixedly on the annular partition plate 8 with the center electrode pieces 2a confronting the lamp mounting opening 5 and also with the connecting piece 2*b* fixed to a substantially intermediate portion of the radial rib 8*a* integral with the annular partition plate 8. On the other hand, the peripheral electrode 3 is also of one-piece construction formed by the use of a metal press work and includes a plurality of peripheral electrode pieces 3*a*connected at one end together by means of a connecting piece 3*b*. This peripheral electrode 3 is mounted on an outer periphery of the cylindrical support wall 11 with the peripheral electrode pieces 3a confronting the lamp mounting opening 5. As a matter of design, the center and peripheral electrode pieces 2*a* and 3*a* are so positioned as to engage the center and peripheral contact points 106 and 107 of the lamp L when the latter is mounted in the lamp socket S.

The electrode shielding means 4 has a function of preventing at least one of the center and peripheral electrodes 2 and 3 from being exposed through the lamp mounting opening 5 to such an extent that would be likely to permit a finger of the user to touch the electrode when the lamp L is removed from the lamp socket S or when the lamp L has not yet been mounted in the lamp socket S. In other words, the electrode shielding means 4 functions to avoid an accidental contact of the user's finger with the electrode.

This electrode shielding means 4 comprises a substantially cylindrical hollow insert 12 made of an electrically insulating material and having an outer diameter substantially equal to the diameter of the center hole 10 in the annular partition plate 8. This insert 12 has first and second ends opposite to each other, said second end being closed by an end wall 12*a*. This insert 12 is formed with a split groove 12 extending inwardly from the first end towards the second end thereof and having a width substantially equal to or slightly greater than the width of the radial rib 8*a* of the annular partition plate 8. In the vicinity of the second end of the insert 12, the insert 12 is also formed with a radially outwardly extending flange 14 of an outer diameter greater than the diameter of the center hole 10.

The cylindrical hollow insert 12 of the above described structure is accommodated within the casing 1 with the split groove 13 loosely receiving therein the radial rib 8*a* of the annular partition plate 8. In this condition, the first end of the cylindrical hollow insert 12 is positioned inside the lamp mounting opening 5 and the second end thereof is positioned on one side of the annular partition plate 8 adjacent the end wall 1*a*. Accordingly, the cylindrical hollow insert 12 within the casing 1 will not separate from the casing 1 through the lamp mounting opening 5 since the radial flange 14 is engaged with an inner peripheral edge of the annular partition plate 8 as best shown in FIG. 1. As will be described later, the cylindrical hollow insert 12 is movable along a longitudinal axis of the casing 1 between a projected position, as shown in FIG. 1, and a retracted position with the radial flange 14 disengaged from the inner peripheral edge of the annular partition plate 8. It is to be noted that the cylindrical hollow insert 12 has an axial length so selected that when the insert 12 is in the projected position it may protrude towards the lamp mounting opening 5 so as to encloses the center and peripheral electrodes 2 and 3, or an end face of the first end of the insert 12 may be in level with or situated outside the plane of the opening at the first end of the casing 1.

The electrode shielding means 4 includes a biasing means in the form of a coil spring 15 for biasing the cylindrical hollow insert 12 to the projected position. This coil spring 15 is interposed between the end wall of the insert 1 2 and the end wall 1*a* of the casing 1. The cylindrical hollow insert 12 so biased normally to the projected position by the coil spring 15 assumes a position, as shown in FIG. 1, intervening between the center and peripheral electrodes 2 and 3 and, accordingly, unless the insert 12 is moved to the retracted position against the coil spring 15, access of the user's finger to the electrodes is prevented advantageously.

The lamp socket S of the construction shown in and described with reference to FIGS. 1 and 2 operates in the following manner. As the lamp L is mounted onto the casing 1 with the lamp mouthpiece 105 inserted into the socket mounting opening 5, the cylindrical hollow insert 12 is pushed backwards from the projected position towards the retracted position against the coil spring 15. With the hollow cylindrical insert 12 so moved to the retracted position, the center and peripheral contact points 106 and 107 on the lamp mouthpiece 105 are engaged respectively with the center and peripheral electrodes 2 and 3 within the casing 1.

Conversely, when the lamp L received in the lamp socket S is removed from the lamp socket S, the lamp L is popped up by the biasing force of the coil spring 15 to emerge outwardly from the lamp socket S, accompanied by return of the cylindrical hollow insert 12 to the projected position to thereby making it difficult for the user's finger to gain access to the electrodes, i.e., to thereby conceal the electrodes. Simultaneously therewith, the cylindrical hollow insert 12 assumes a position between the center and peripheral electrodes 2 and 3 and, therefore, occurrence of any possible electric discharge which would otherwise take place between the center and peripheral electrodes 2 and 3 when an electric power is supplied thereto can advantageously be minimized. Also, shortcircuitting between the electrodes 2 and 3 as a result of ingress of metal pieces and/or deformation of at least one of the center and peripheral electrodes 2 and 3 can also be minimized advantageously.

(Second Embodiment)

The lamp socket S according to a second preferred embodiment of the present invention is shown in FIGS. 3 to 6. In the foregoing embodiment, the annular partition plate 8 divides the interior of the casing 1 into two chambers adjacent the lamp mounting opening 5 and the end wall 1*a*, respectively, with the coil spring 15 accommodated within the chamber adjacent the end wall 1*a* to hold the cylindrical hollow insert 12 at the projected position. However, in the second embodiment which will now be described in detail, the use of the annular partition plate 8 such as required in the foregoing embodiment is dispensed with and, instead, the coil spring 15*a* is disposed within the casing 1 so as to extend within a space generally intermediate between the center and peripheral electrodes 2 and 3 in a direction coaxial with the longitudinal axis of the casing 1.

Figure 3:
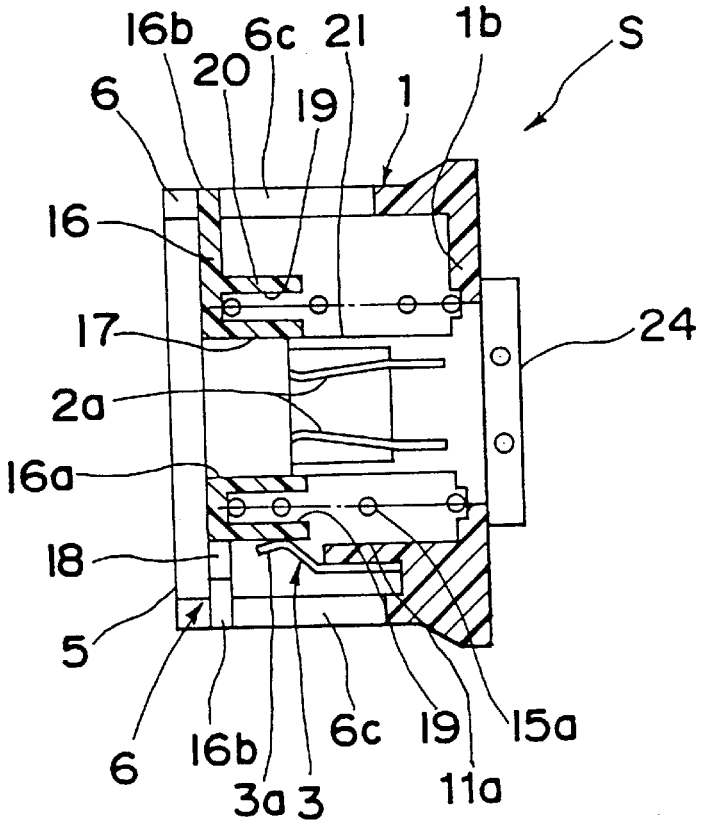
FIG. 3 is a schematic longitudinal sectional view of a lamp socket according to a second preferred embodiment of the present invention.
Figure 4:
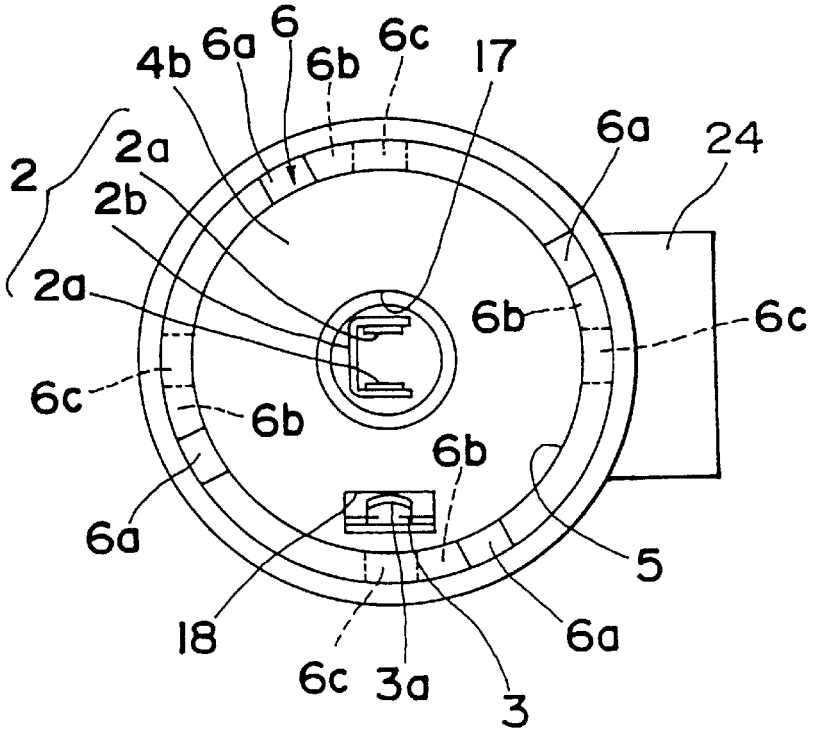
FIG. 4 is a front end view of the lamp socket shown in FIG. 3.

As shown in FIGS. 3 and 4, the cylindrical casing 1 has first and second ends opposite to each other with the second end closed by an end wall 1*b*.The line retainer box 24 is integrally formed with an outer surface of the end wall 1*b* so as to protrude radially outwardly of the casing 1.

The first end of the cylindrical casing 1 has the lamp mounting opening 5 defined therein for receiving the mouthpiece 105 of the lamp L when the latter is mounted onto the lamp socket S and delimited by the cylindrical end wall formed with at least one pair (two pairs being shown in the illustrated embodiment) of the generally L-shaped bayonet mounting grooves 6 in a manner similar to that employed in the foregoing embodiment. Each L-shaped bayonet mounting groove 6 includes an axial groove portion 6*a* and a circumferential groove portion 6*b*perpendicular to the axial groove portion 6*a* and extending a distance circumferentially of the first end of the casing 1. These L-shaped bayonet mounting grooves 6 are spaced circumferentially from each other for receiving the corresponding bayonet mounting pins 108 on the lamp mouthpiece 105 in a manner known to those skilled in the art. It is to be noted that, for the reason which will become clear from the subsequent description, a free end of the circumferential groove portion 6*b* of each of the bayonet mounting groove 6 is communicated with an axial guide groove 6*c* defined in that cylindrical end wall so as to extend axially of the casing 1.

The end wall 1*b* is integrally formed with an electrically insulating cylindrical barrier 21 in coaxial relation therewith so as to protrude towards the lamp mounting opening 5. The center electrode 2 is enclosed inside the cylindrical barrier 21 and is secured to the end wall 1*b*. This cylindrical barrier 21 has an axial length so selected as to permit one end thereof remote from the end wall 1*b* to completely enclose the center electrode 2 inside the cylindrical barrier 21 as shown in FIG. 3, or to be positioned axially outwardly of the center electrode 2.

The center electrode 2 employed in the second embodiment of the present invention is substantially similar to that employed in the foregoing embodiment, but the peripheral electrode 3 is shown as including a single peripheral electrode piece 3*a*. This peripheral electrode piece 3*a* is supported by a support wall 11*a* formed integrally with an inner peripheral surface of the casing 1 so as to protrude towards the lamp mounting opening 5. Although not shown, the power supply lead lines are drawn from the center and peripheral electrodes 2 and 3 and extend outwardly from the lamp socket S through the line retainer box 24 integral with the outer surface of the end wall 1*b* for connection with the electric power source.

Figure 5:
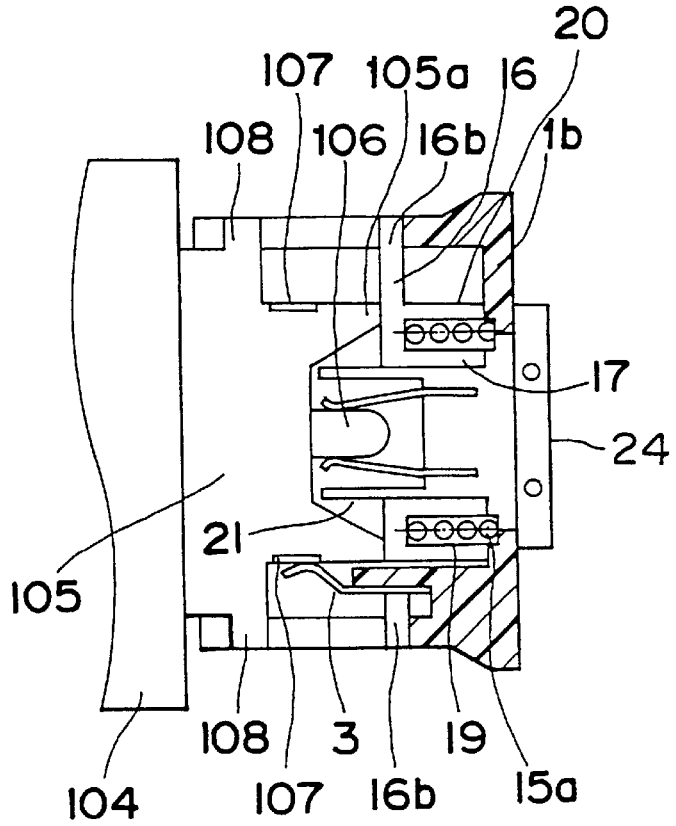
FIG. 5 is a view similar to FIG. 3, showing the lamp socket receiving a lamp.

The electrode shielding means 4 employed in the embodiment shown in FIGS. 3 to 6 comprises an annular end plate 16 of electrically insulating material having a center hole 16*a* of a diameter substantially equal to the outer diameter of the cylindrical barrier 21 and also having radial lugs 16*b* that are slidingly engaged in the respective axial guide grooves 6*c*, and a coil spring 15*a* for normally biasing the annular end plate 16 towards a projected position as will be described later. A surface of the annular end plate 16 facing the end wall 1*b* is formed with an inner sleeve 17 coaxial with the center hole 16*a* and also with an outer sleeve 20 spaced a distance radially outwardly from the inner sleeve 17 for defining a spring receiving groove 19 in cooperation with the inner sleeve 17. This annular end plate 16 is also formed with a generally rectangular hole 18 at a location radially offset from the center hole 16*a* for permitting the peripheral electrode 3 to be exposed therethrough to the lamp mounting opening 5 when the annular end plate 16 is moved from the projected position towards a retracted position as shown in FIG. 5 as will be described later.

Figure 6:
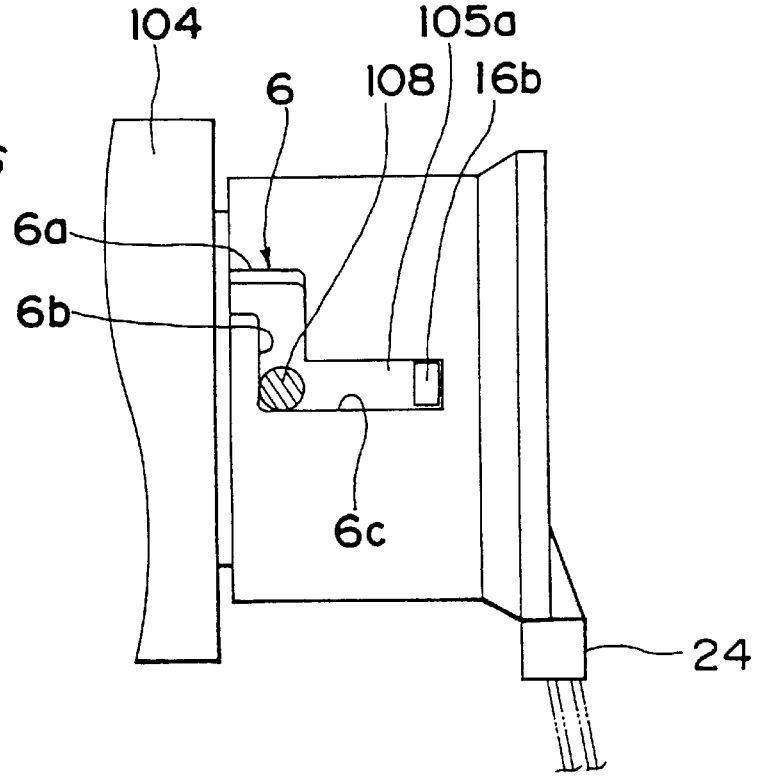
FIG. 6 is a schematic side view of the lamp socket shown in FIG. 3 with the lamp received therein.

The coil spring 15*a* is interposed between the end wall 1*b* and the annular end plate 16 with one end received within the spring receiving groove 19 and the other end held in abutment with the end wall 1*b*. Accordingly, the annular end pate 16 is biased to the projected position by a biasing force of the coil spring 15*a* with the radial lugs 16*b* in the axial guide grooves 6*c* engaged with respective walls defining the circumferential grooves 6*b* as shown in FIG. 6. However, when a pushing force acts on the annular end plate 16 through the lamp mounting opening 5 as will be described later, the annular end plate 16 is moved against the biasing force of the coil spring 15*a* towards the retracted position as shown in FIG. 5. During the movement of the annular end plate 16 towards the retracted position, the peripheral electrode 3 is exposed to the outside through the rectangular hole 18 defined in the annular end plate 16 as hereinbefore described.

Where the lamp socket S according to the second embodiment of the present invention is used in practice, the protective skirt 105*a* surrounding the center contact point 106 of the HID lamp L must have an axial length sufficient to allow the center contact point 106 to firmly engage the center electrode 2 when upon insertion of the lamp mouthpiece 105 into the lamp mounting opening 5 in the lamp socket S an annular free end of the protective skirt 105*a* then brought into contact with the annular end plate 16 urges the latter to the retracted position as shown in FIG. 5.

The lamp socket S according to the second embodiment of the present invention can be used in a manner, and bring about effects, similar to that according to the foregoing embodiment. Specifically, as the lamp L is mounted onto the casing 1 with the lamp mouthpiece 105 inserted into the socket mounting opening 5, the annular end plate 16 is pushed inwardly of the casing 1 from the projected position towards the retracted position against the coil spring 15*a* with the radial lugs 16*b* guided along the corresponding axial guide grooves 6*c*. Upon arrival of the annular end plate 16 at the retracted position, the lamp L has to be turned a certain angle about the longitudinal axis of the casing 1 to bring the bayonet mounting pins 108 to be engaged in the associated circumferential groove portions 6*b* to thereby accomplish a bayonet engagement between the lamp L and the lamp socket S and also to allow the center and peripheral contact points 106 and 107 to be engaged respectively with the center and peripheral electrodes 2 and 3 in the casing 1.

Conversely, when the lamp L received in the lamp socket S is removed from the lamp socket S, the lamp L is popped up by the biasing force of the coil spring 15*a* to emerge outwardly from the lamp socket S, accompanied by return of the annular end plate 16 to the projected position to thereby close the lamp mounting opening 5, making it difficult for the user's finger to gain access to the electrodes 2 and 3, i.e., to thereby conceal the electrodes 2 and 3 completely. Simultaneously therewith, the cylindrical barrier 21 surrounds the center electrode 2 at all times and, therefore, occurrence of any possible electric discharge which would otherwise take place between the center and peripheral electrodes 2 and 3 when an electric power is supplied thereto can advantageously be minimized.

(Third Embodiment)

The lamp socket S according to a third preferred embodiment of the present invention is shown in FIGS. 7 to 13. As discussed in connection with the prior art lamp socket, ignition of the HID lamp requires application of the high voltage pulse to the lamp. Should the high voltage pulse be applied across the center and peripheral electrodes in the lamp socket while the lamp has not yet been mounted in the lamp socket, there is a great possibility that electric discharge may occur between the center and peripheral electrodes and materials used to form the lamp socket may consequently be burned, fused and/or fired. The lamp socket S according to the third embodiment of the present invention is particularly designed to minimize this possibility.

Figure 8:
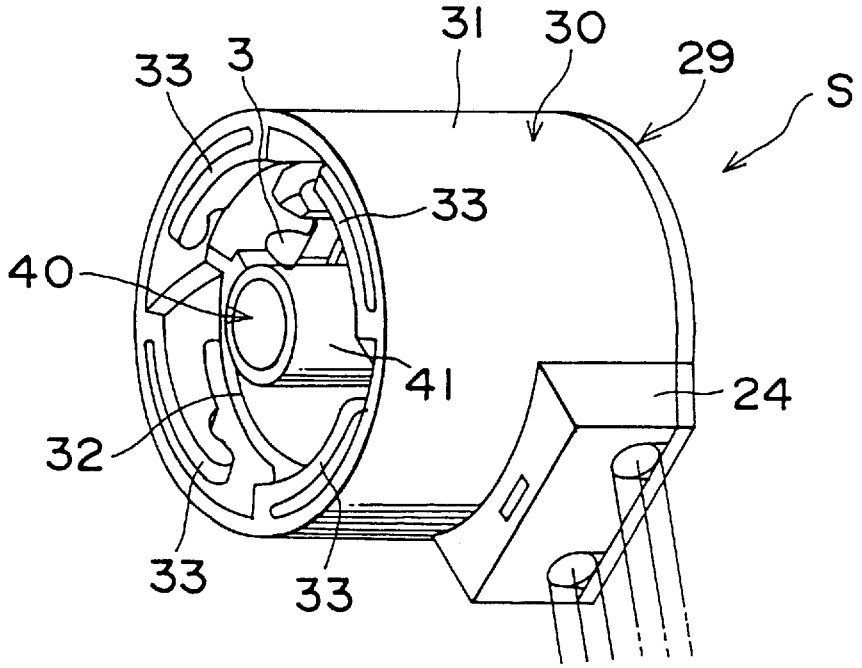
FIG. 8 is a perspective view, on an enlarged scale, showing the lamp socket shown in FIG. 7.
Figure 9:
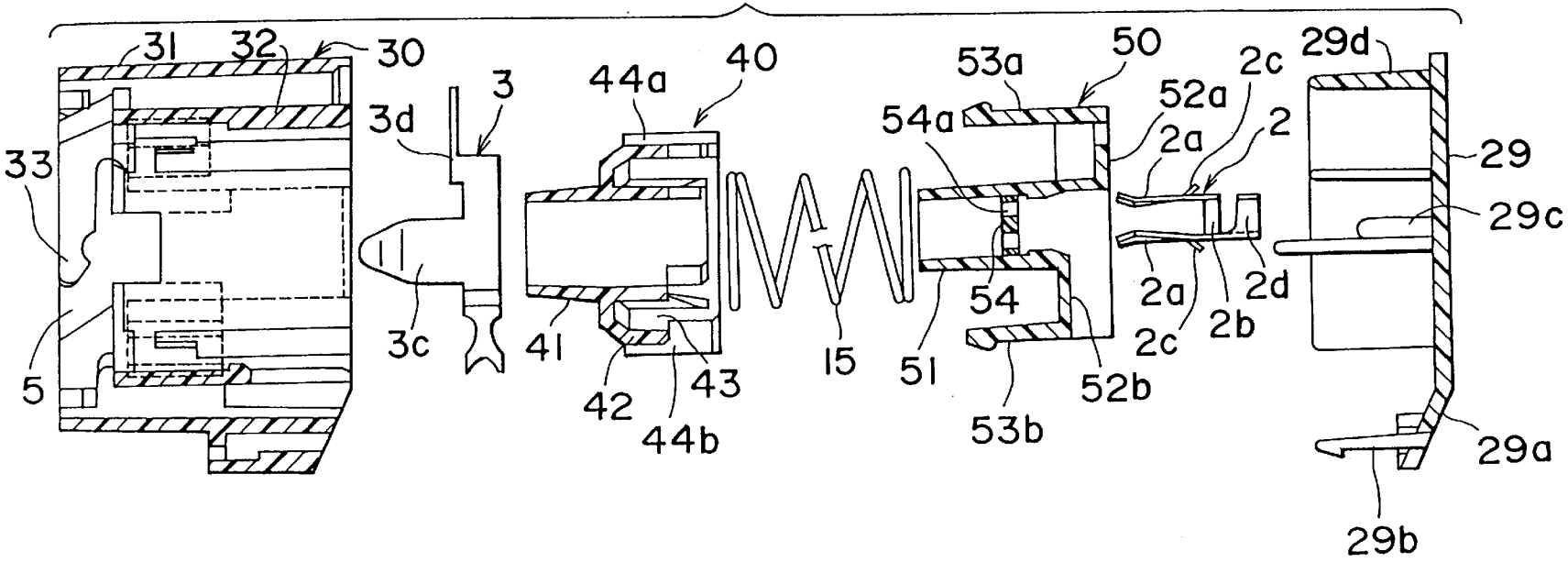
FIG. 9 is an exploded view, on an enlarged scale, of the lamp socket shown in FIG. 7.
Figure 10:
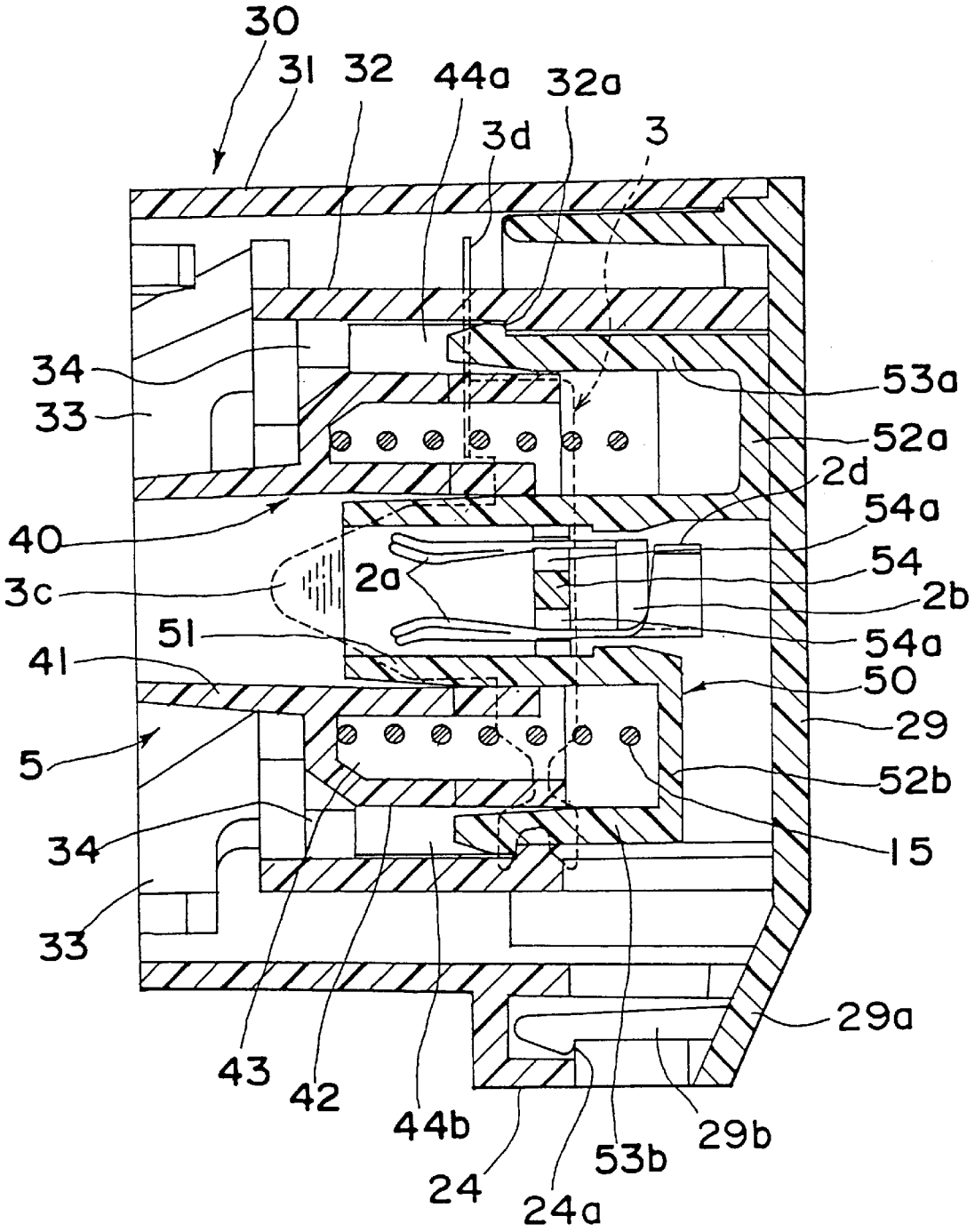
FIG. 10 is a longitudinal sectional view, on a further enlarged scale, showing the lamp socket shown in FIG. 7 with an insert held at a projected position.

Referring now to FIGS. 7 to 11, the illustrated lamp socket S makes use of a double-walled casing 30 made of electrically insulating material and including a substantially cylindrical outer barrel 31 and an inner barrel 32 positioned coaxially inside the outer barrel 31. The outer barrel 31 has an axial length greater than that of the inner barrel 32, but the both are positioned relative to each other so that respective second or rear ends of the outer and inner barrels 31 and 32 remote from the lamp mounting opening 5 are in flush with each other while a first or front end of the inner barrel 32 adjacent the lamp mounting opening 5 is set back a predetermined distance inwardly from a first or front end of the outer barrel 31 as best shown in FIG. 10. The second or rear end of the casing 30 is closed by an end lid 29 and, in this condition, the respective rear ends of the outer and inner barrels 31 and 32 are held in contact with the end lid 29.

Although not shown for the sake of clarity to show the details of major component parts of the lamp socket S, a plurality of radial ribs are integrally formed with the casing 30 to connect the outer and inner barrels 31 and 32 together in coaxial relation and are so sized as to form a generally horseshoe-shaped gap between respective rear halves of the outer and inner barrels 31 and 32 for accommodating the peripheral electrode 3 as will be described later.

As best shown in FIG. 8, a plurality of tongues 33 which define the L-shaped bayonet mounting grooves 6 in cooperation with the front end of the inner barrel 32 are formed integrally with the casing 30 and positioned between respective front halves of the outer and inner barrels 31 and 32. Since the bayonet mounting grooves 6 are of a shape similar to the shape of a figure "L" as discussed in connection with the previously described embodiments of the present invention and cooperate with the bayonet mounting pins 108 on the lamp mouthpiece 105 to accomplish a bayonet engagement between the lamp L and the lamp socket S, each of the tongues 33 is of a shape generally complemental to the shape of the corresponding bayonet mounting groove 6.

As clearly shown in FIG. 10, the front end of the inner barrel 32 is integrally formed with at least one pair of engagement pieces 34 so as to extend radially inwardly therefrom. Those engagement pieces 34 serves to define a projected position for a tubular insert 40 of an electrically insulating material as will be described in more detail later. It is to be noted that in place of the pair of the radially inwardly extending engagement pieces 34, a radially inwardly extending annular wall may be employed for the same purpose.

The inner barrel 32 accommodates therein the tubular insert 40, a generally cylindrical center electrode carrier 50 made of an electrically insulating material and movable relative to the tubular insert 40, and a coil spring 1 5 accommodated within an annular space between the tubular insert 40 and the cylindrical center electrode carrier 50 for biasing the tubular insert 40 normally to the projected position.

The tubular insert 40 includes a sleeve 41 and a skirt 42 formed integrally with a generally intermediate portion of the sleeve 41 so as to extend rearwardly (or rightwards as viewed in FIG. 9) of the sleeve 41 while spaced a predetermined distance radially outwardly from the sleeve 41. An annular space 43 so delimited between the rear end of the sleeve 41 and the skirt 42 is utilized to accommodate a corresponding end of the coil spring 15. The skirt 42 has an outer peripheral surface formed with diametrically opposed slide grooves 44*a* and 44*b* defined therein so as to extend in a direction longitudinally thereof. In the illustrated embodiment, each slide grooves 44*a* and 44*b* is defined by a pair of ribs formed integrally on the outer peripheral surface of the skirt 42. The tubular insert 40 of the structure described above is accommodated within the inner barrel 32 of the casing 30 for sliding movement in a direction axially of the casing 30.

The center electrode carrier 50 when viewed in FIG. 9 represents a generally W-shaped cross-section and is made of an electrically insulating material.

This center electrode carrier 50 is of one-piece construction including a tubular sheath 51, two arms 52*a* and 52*b* formed with a rear end of the tubular sheath 51 remote from the tubular insert 40 so as to extend radially outwardly therefrom, and fingers 53*a* and 53*b* extending from respective free ends of the arms 52*a* and 52*b* towards the tubular insert 40 and generally parallel to the tubular sheath 51. The tubular sheath 51 is formed integrally with an electrode holder piece 54 extending radially across the hollow of the tubular sheath 51 and having electrode holding perforations 54*a* defined therein. This tubular sheath 51 has an outer diameter substantially equal to or slightly smaller than the inner diameter of the sleeve 41 of the tubular insert 40.

In an assembled condition as shown in FIG. 10, the tubular sheath 51 of the center electrode carrier 50 is slidably received within the sleeve 41 of the tubular insert 40 with the fingers 53*a* and 53*b* of the center electrode carrier 50 slidably engaged in the respective slide grooves 44*a* and 44*b* that are formed in the outer peripheral surface of the skirt 42. Accordingly, although the tubular insert 40 is axially slidable relative to the center electrode carrier 50, it does not rotate relative to the center electrode carrier 50.

Figure 11:
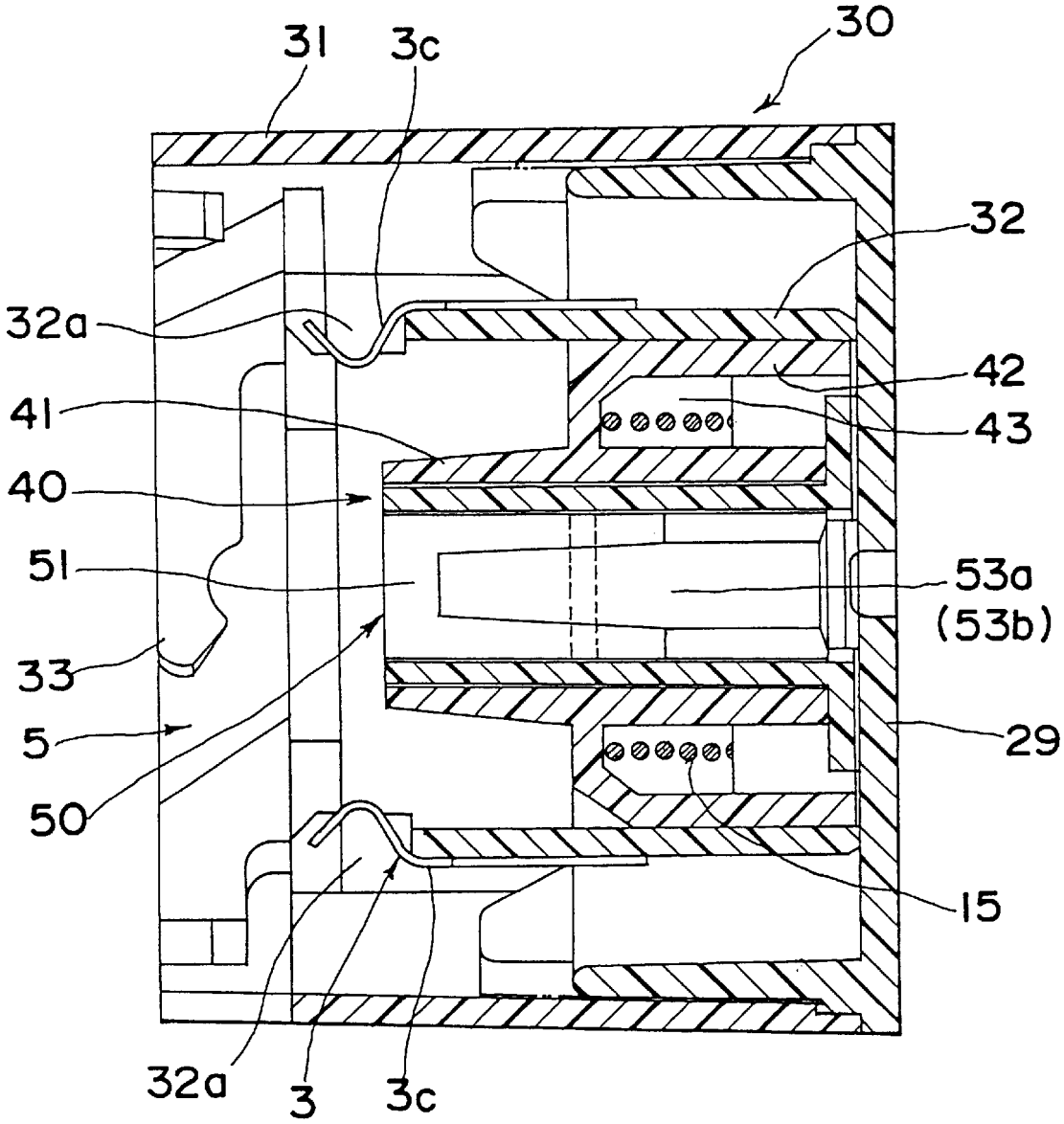
FIG. 11 is a view similar to FIG. 10, showing the lamp socket shown in FIG. 7 with an insert held at a retracted position.

The coil spring 15 having one end received within the annular space 43 between the rear end of the sleeve 41 and the skirt 42 has the opposite end positioned between the tubular sheath 51 and the fingers 53*a* and 53*b* of the center electrode carrier 50 and held in abutment with the arms 52*a* and 52*b*. In other words, the coil spring 15 is interposed between the tubular insert 40 and the center electrode carrier 50 to normally bias the tubular insert 40 to the projected position relative to the center electrode carrier 50. This condition is illustrated in FIG. 10 while a condition in which the tubular insert 40 is moved to the retracted position relative to the center electrode carrier 50 against the biasing force of the coil spring 15 is shown in FIG. 11.

Considering the coil spring 15 interposed between the tubular insert 40 and the center electrode carrier 50 as hereinabove described, there may be a possibility that when the center electrode carrier 50 is to be mounted during assembly subsequent to mounting of both of the tubular insert 40 and the coil spring 15 into the casing 30, the center electrode carrier 50 may be accidentally popped up by the action of the coil spring 15 unless the rear end of the casing 30 is skillfully immediately closed by the end lid 29. In order to eliminate this possibility and also to facilitate assemblage of the lamp socket S, the illustrated embodiment makes use of a circumferentially extending shoulder 32*a* formed in a portion of the inner peripheral surface of the inner barrel 32 generally intermediate of the axial length of the inner barrel 32 and, on the other hand, respective tips of the fingers 53*a* and 53*b* of the center electrode carrier 50 are so shaped and so configured to represent hook ends cooperable with the circumferential shoulder 32. Accordingly, upon insertion of the center electrode carrier 50 into the inner barrel 32 of the casing, the hook ends of the associated fingers 53*a* and 53*b* are, by the action of their own resiliency, urged to engage the circumferential shoulder 32*a* in the inner barrel 32, thereby preventing the center electrode carrier 50, once inserted into the inner barrel 32, from being accidentally separated therefrom by the biasing force of the coil spring 15.

The center electrode 2 may be similar in structure to that shown and described in connection with the first preferred embodiment of the present invention. However, in the third embodiment now under discussion, the center electrode 2 is supported by the center electrode carrier 50 in the following manner. The center electrode 2 has the center electrode pieces 2*a* passed through the respective electrode holding perforations 54*a* in the electrode holder piece 54 within the tubular sheath 52 so that as shown in FIG. 10, the center electrode pieces 2*a* occupy a position within a portion of the hollow of the tubular sheath 51 adjacent the lamp mounting opening 5. In order to avoid any possible separation of the center electrode 2 once retained by the electrode holder piece 54, it is preferred that each of the center electrode pieces 2*a* is formed with respective wedge-like projections 2*c* at the root thereof, that is, adjacent the connecting piece 2*b*. Thus, when the center electrode pieces 2*a* are passed through the electrode holding perforations 54*a* in the electrode holder piece 54, the wedge-like projections 2*c* establish a wedge engagement with the walls defining the electrode holding perforations 54*a* to thereby permit the center electrode 2 as a whole to resist to any possible pulling force which may be applied when the center electrode 2 is to be removed from the tubular sheath 51.

It is to be noted that the wedge-like projections 2*c* discussed above as employed in the practice of the third embodiment of the present invention may also be employed in association with the center electrode in the lamp socket according to any one of the first and second embodiments of the present invention. In either case, regardless of the presence or absence of the wedge-like projections 2*c*, the center electrode 2 may be molded together with the electrode carrier 50 by the use of any known insert-molding technique. It is also to be noted that reference numeral 2*d* shown in FIGS. 9 and 10 represents a terminal piece of the center electrode 2 with which the associated lead line 113 is to be soldered or connected by crimping. The center electrode 2 including this terminal piece 2*d* can, of course, be formed by the use of a metal blanking technique or any other suitable metal press work.

The details of the peripheral electrode 3 employed in the practice of the third embodiment of the present invention will now be described. As shown in FIGS. 9 to 11, the peripheral electrode 3 includes the peripheral electrode pieces 3*c* spaced a distance from each other as is the case with that used in any one of the foregoing embodiments. However, unlike the peripheral electrode pieces 3*a* of the peripheral electrode 3 employed in the practice of any one of the first and second embodiments, the peripheral electrode pieces 3*c* are spaced 180° about the longitudinal axis of the casing 30 and connected together by means of a connecting piece 3*d*. In other words, while the peripheral electrode pieces 3*c* have one end configured and corrugated in a manner similar to those used in any one of the foregoing embodiments, the other end of each peripheral electrode piece 3*c* is continued to the connecting piece 3*d*. This connecting piece 3*d* does, when viewed in a direction conforming to the longitudinal axis of the lamp socket S, represent a generally horseshoe shape. This connecting piece 3*d* is so configured and so sized as to be received within the generally horseshoe-shaped gap defined between the respective rear halves of the outer and inner barrels 31 and 32 of the casing 30.

When the peripheral electrode 3 is mounted with the connecting piece 3*d* received within the horseshoe-shaped gap between the outer and inner barrels 31 and 32 as described above, the peripheral electrode pieces 3*c* extends axially along the outer peripheral surface of the inner barrel 32 with the corrugated tips thereof partially protruding radially inwardly into the hollow of the inner barrel 32 through respective grooves 32*a* which are defined in the wall of the inner barrel 32 as shown in FIG. 11. Accordingly, as the lamp mouthpiece 105 is inserted into the lamp mounting opening 5 in the lamp socket S, the protective skirt 105*a* of the lamp mouthpiece 105 pushes the tubular insert 40, causing the latter to be moved from the projected position towards the retracted position against the coil spring 15 and, at the same time, the center and peripheral contact points 106 and 107 of the lamp L are brought into engagement with the center and peripheral electrodes 2 and 3. At this time, the center electrode pieces 2*a* are firmly engaged with the center contact point 106 by the effect of their own resiliency and the peripheral electrode pieces 3*c* are firmly engaged with the peripheral contact point 107 from a radially inward direction by the effect of their own resiliency.

After the tubular insert 40, the center electrode carrier 50 and the coil spring 15 have been mounted in the inner barrel 32 of the casing 30, the end lid 29 is capped onto the casing 30 to close the rear end thereof. This end lid 29 may be in the form of a disc-shaped wall member, but the illustrated embodiment it concurrently serves as a lid for the line retainer box 24 formed integrally with the outer barrel 31 of the casing 30. For this reason, as viewed in FIGS. 9 and 10, the end lid 29 has a lower portion formed with a flap 29*a* which serves as the lid for the line retainer box 24, said flap 29*a* being in turn formed with a hook member 29*b* protruding generally parallel to the longitudinal axis of the casing 30. This hook member 29*b* is, when the end lid 29 is mounted onto the rear end of the casing 30, engaged with an engagement piece 24*a* formed inside the line retainer box 24 to thereby avoid any possible accidental separation of the end lid 29 from the rear end of the casing 30.

The end lid 29 has a peripheral portion formed with a flange 29*d*, a part of which is cut off in alignment with the flap 29*a*. This flange 29*d* does, when the end lid 29 is mounted onto the rear end of the casing 30, slidingly engage an inner peripheral surface of the outer barrel 31 with the hook member 29*b* subsequently brought into engagement with the engagement piece 24*a* and, therefore, the end lid 29 does not undergo any rotation about the longitudinal axis of the casing 30.

Also, in order to securely position the center electrode 2, the end lid 29 is also formed with a pusher rod 29*c* so as to protrude from a generally central portion thereof towards the center electrode 2 so that when the end lid 29 is mounted onto the rear end of the casing 30, a free end of the pusher rod 29*c* can urge the center electrode 2 against the electrode holder piece 54.

Respective portions of the lead-in lines 113 which extend inside the line retainer box 24 are supported within the line retainer box 24 so as to extend in a generally zig-zag fashion so that they will not separate from the line retainer box 24 even though a relatively strong pull is applied to outer portions of the lead-in lines 113.

The lamp socket S according to the embodiment shown in FIGS. 9 to 11 may be used in the following manner.

So long as the lamp L has not yet been mounted, the movable component parts of the lamp socket S assume such a condition as shown in FIG. 10. In this condition, the tubular insert 40 is held at the projected position as shown in FIG. 10 by the action of the coil spring 15. At this time, the center electrode pieces 2*a*, situated at all times within the tubular sheath 51 of the center electrode carrier 50, and the peripheral electrode pieces 3*c* having their free ends partially protruding into the hollow of the inner barrel 32 through the grooves 32*a* in the inner barrel 32 are partitioned by double walls, that is, the rear end of the sleeve 41 of the tubular insert 40 and the skirt 42 of the tubular insert 40. Accordingly, this double-walled structure of the tubular insert 40 serves as an electric insulator to thereby avoid any possible electric discharge which would otherwise occur between the center electrode 2 and the peripheral electrode 3 when the high voltage pulse is erroneously applied across the electrodes in the lamp socket S while the lamp L has not yet been mounted.

When the lamp L is to be mounted onto the lamp socket S, the lamp mouthpiece 105 is to be inserted into the lamp mounting opening 5. When the bayonet mounting pins 108 on the lamp mouthpiece 105 reach junctions between the axial grooves (shown by 6*a* in FIG. 6) and the circumferential grooves (shown by 6*b* in FIG. 6) and the lamp L is then turned a certain angle about the longitudinal axis of the lamp socket S, a bayonet engagement between the lamp L and the lamp socket S takes place in a manner well known to those skilled in the art. It is, however, to be noted that as the lamp mouthpiece 105 is inserted into the lamp mounting opening 5, the protective skirt 105*a* integral with the lamp mouthpiece 105 is brought into contact with an annular wall between the sleeve 41 and the skirt 42 of the tubular insert 40 and further push of the lamp L causes the tubular insert 40 to move towards the retracted position against the coil spring 15.

Simultaneously with arrival of the tubular insert 40 at the retracted position as shown in FIG. 11, the center contact point 106 of the lamp L is caught in between the center electrode pieces 2*a* and, on the other hand, the corrugated free end portions of the peripheral electrode pieces 3*c* situated within the grooves 32*a* in the inner barrel 32 are brought into contact with the peripheral contact point 107 of the lamp L. Thereafter, the lamp L has to be turned a certain angle about the longitudinal axis of the casing 30 to complete mounting of the lamp L onto the lamp socket S.

Removal of the lamp L from the lamp socket S can readily be accomplished merely by turning the lamp L in the opposite direction about the longitudinal axis of the casing 30. By so doing, the lamp L can be popped up from the lamp mounting opening 5 by the action of the coil spring 15 which then concurrently urges the tubular sheath 40 from the retracted position towards the projected position.

So far illustrated, the tubular insert 40 is of a size sufficient to allow the end of the sleeve 41 adjacent to the lamp mounting opening 5 to be in flush with the free end of the corresponding end of the outer barrel 31 adjacent the lamp mounting opening 5 when the tubular insert 40 is in the projected position. However, the present invention may not be always limited thereto, and that end of the sleeve 41 may protrude either outwardly or inwardly from that end of the outer barrel 31.

Figure 12:
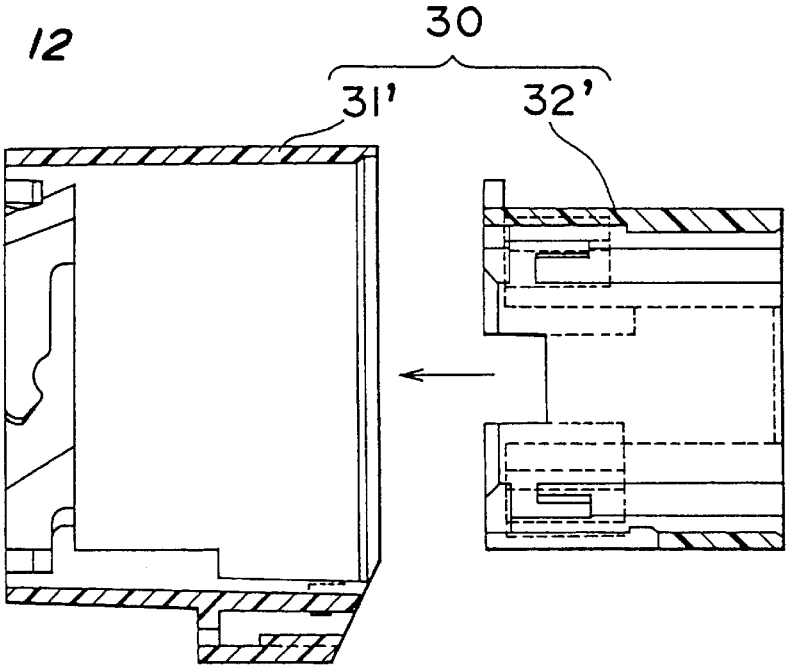
FIG. 12 is a schematic longitudinal sectional view showing a first modified form of the lamp socket shown in FIG. 7.

In the foregoing embodiment shown in and described with reference to FIGS. 7 to 11, the casing 30 is of the type formed integrally with the outer and inner barrels 31 and 32. However, as shown in FIG. 12, the casing 30 may be of a construction wherein separate outer and inner barrels 31' and 32' are employed with the inner barrel 32' positioned inside the outer barrel 31'.

Figure 13:
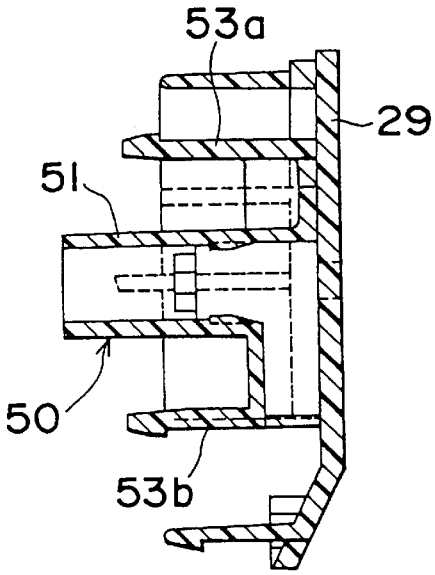
FIG. 13 is a longitudinal sectional view showing a modified form of an end plate employed in the lamp socket shown in FIG. 7.

Also, the center electrode carrier 50 and the end lid 29 may be integrally formed together by the use of any known plastic molding technique as shown in FIG. 13. Alternatively, even though the center electrode carrier 50 and the end lid 29 may be members separate from each other, but bonded together. According to a modified form of the casing 30 shown in FIG. 14, the casing 30 is integrated together with the center electrode carrier 50. Even in this case, integration of the casing 30 with the center electrode carrier 50 may be carried out during a plastic molding process or by bonding after they have been prepared independently and separately.

Figure 14:
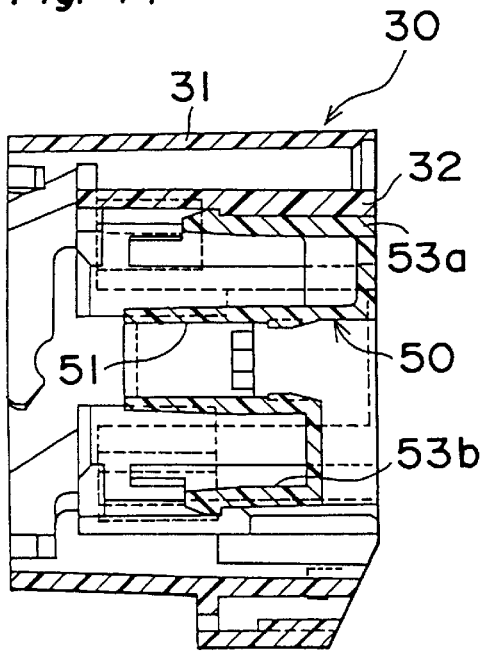
FIG. 14 is a longitudinal sectional view showing a modified form of a casing employed in the lamp socket shown in FIG. 7.

In any event, where the modification shown in any one of FIGS. 13 and 14 is to be employed, the coil spring 15 and the tubular insert 40 can be mounted into the casing through the lamp mounting opening 5.

(Industrial Applicability)

The present invention having been so constructed as hereinbefore described in detail can bring about the following numerous advantages.

1) Since so long as the lamp has not yet been mounted the insert is held at the projected position adjacent the lamp mounting opening, it makes difficult for the user's finger to gain access to the center electrode. Accordingly, any possible accident of electric shock can advantageously be minimized.

2) So long as the lamp has not yet been mounted, that is, so long as the insert is held at the projected position, the double-walled structure intervenes between the center and peripheral electrodes. Therefore, any possible electric discharge which would otherwise occur between the center and peripheral electrodes when the high voltage pulse is erroneously applied across the electrodes can advantageously be minimized.

3) Since the coil spring urges the insert to the projected position, a firm electric contact between the center electrode of the lamp socket and the center contact point of the lamp can advantageously be established upon mounting of the lamp onto the lamp socket.

4) Considering that the center electrode pieces and the peripheral electrode pieces are arranged in line with each other in a direction radially of the casing, not only can any possible fluctuation in dimension of the lamp be accommodated, but also a stabilized electric contact between the center and peripheral electrodes will not be adversely affected under the influence of vibration.

5) Considering that the center electrode carrier is a member separate from the casing and also from the insert, a job of connecting electric lines and a job of temporarily holding the insert and the coil spring in the casing can readily be carried, thereby facilitating an easy assemblage of the lamp socket as a whole.

Thus, the present invention involves numerous industrial applicabilities because of the peculiar construction hereinbefore fully discussed.

What is claimed is:

1. A lamp socket for use with a lamp including a lamp mouthpiece having a center contact element and a peripheral contact element, said lamp socket comprising:

a hollow casing having a lamp mounting opening defined at one end, an opposite end of said hollow casing being closed;

an electrode carrier member disposed inside said hollow casing;

a center electrode disposed on said electrode carrier member at a location coaxial with an axis perpendicular to a plane of said lamp mounting opening, said center electrode being engageable with said center contact element in the lamp mouthpiece;

a peripheral electrode disposed on said electrode carrier member at a location offset laterally from said center electrode. said peripheral electrode also being offset from said axis, said peripheral electrode being engageable with said peripheral contact element in said lamp mouthpiece;

an electrode shield disposed within said hollow casing for movement between a projected position and a retracted position; and a biasing device that biases said electrode shield towards said projected position, said biasing device being operable to permit said electrode shield to move towards said retracted position against a biasing force thereof in response to an insertion of the lamp mouthpiece into said lamp mounting opening;

wherein said electrode shield permits said center electrode and said peripheral electrode to be electrically engaged with said center contact element and said peripheral contact element, respectively, in said lamp mouthpiece when said electrode shield is moved to said retracted position, while concealing said center electrode and said peripheral electrode when said electrode shield is in said projected position.

2. The lamp socket of claim 1, wherein said electrode shielding is in the form of an insert element made of an electrically insulating material and accommodated within the casing for movement between the projected and retracted positions such that when the insert element is in the projected position, said insert element surrounds at least said center electrode to conceal the peripheral electrode.

3. The lamp socket of claim 2, wherein said insert element when in the projected position assume a position generally intermediate between the center and peripheral electrode means to thereby prevent an electric discharge from occurring between the center electrode and peripheral electrode.

4. The lamp socket of claim 1, wherein said electrode shielding comprises an annular end plate accommodated within the hallow casing for movement between the projected and retracted position and formed with respective perforations for passage of the center and peripheral electrode during the movement of the annular end plate between the projected and retracted positions, said annular end plate when in the projected position closing the lamp mounting opening with the center and peripheral electrode consequently concealed within the hallow casing.

5. The lamp socket of claim 4, further comprising a tubular barrier made of an electrically insulating material and surrounding the center electrode, and wherein said annular end plate has a center hole defined therein for passage therethrough of the center electrode during movement of the annular end plate between the projected and retracted positions.

6. The lamp socket of claim 2, said electrode carrier comprises a tubular sheath made of an electrically insulating material and accommodating therein the center electrode, said tubular sheath forming a part of the electrode shielding means.

7. A lamp socket for use with a lamp including a lamp mouthpiece having a center contact element and a peripheral contact element, said lamp socket comprising:

a hollow casing having a lamp mounting opening defined at one end, an opposite end of said hollow casing being closed;

an electrode carrier disposed inside said hollow casing;

a center electrode disposed on said electrode carrier member at a location coaxial with an axis perpendicular to a plane of said lamp mounting opening. said center electrode being engageable with said center contact element in the lamp mouthpiece;

a peripheral electrode disposed on said electrode carrier member at a location offset laterally from said center electrode, said peripheral electrode also being offset from said axis, said peripheral electrode being engageable with said peripheral contact element in said lamp mouthpiece;

an electrode shield disposed within said hollow casing for movement between a projected position and a retracted position, said electrode shield being in the form of an insert element made of an elastically insulating material, said electrode shield being accommodated within said hollow casing for movement between said projected position and said retracted position, such that said insert element surrounds at least said center electrode to conceal said center electrode when said insert element is in said projected position; and a biasing device that biases said electrode shield towards said projected position. said biasing device being operable to permit said electrode shield to move towards said retracted position against a biasing force thereof in response to an insertion of the lamp mouthpiece into said lamp mounting opening;

wherein said electrode shield permits said center electrode and said peripheral electrode to be electrically engaged with said center contact element and said peripheral contact element, respectively, in said lamp mouthpiece when said electrode shield is moved to said retracted position, while substantially concealing said center electrode and said peripheral electrode when said electrode shield is in said projected position. said electrode carrier comprising a tubular sheath made of an electrically insulating material and accommodating therein said center electrode, said tubular sheath forming a part of said electrode shield said insert comprising a sleeve accommodating therein said tubular sheath so as to permit said tubular sheath to be movable in a direction parallel to a longitudinal axis of said hollow casing, and an annular skirt surrounding one end of said sleeve adjacent said electrode carrier, and wherein said biasing device is interposed between said electrode carrier and a gap between said annular skirt and said sleeve.

8. The lamp socket of claim 7, wherein said biasing device comprises a coil spring.

9. A lamp socket for use with a lamp including a lamp mouthpiece having a center contact element and a peripheral contact element, said lamp socket comprising:

a hollow casing having a lamp mounting opening defined at one end, an opposite end of said hollow casing being closed;

an electrode carrier disposed inside said hollow casing;

a center electrode disposed on said electrode carrier member at a location coaxial with an axis perpendicular to a plane of said lamp mounting opening, said center electrode being engageable with said center contact element in the lamp mouthpiece;

a peripheral electrode disposed on said electrode carrier member at a location offset laterally from said center electrode, said peripheral electrode also being offset from said axis, said peripheral electrode being engageable with said peripheral contact element in said lamp mouthpiece;

an electrode shield disposed within said hollow casing for movement between a projected position and a retracted position, said electrode shield being in the form of an insert element made of an elastically insulating material, said electrode shield being accommodated within said hollow casing for movement between said projected position and said retracted position, such that said insert element surrounds at least said center electrode to conceal said center electrode when said insert element is in said projected position; and a biasing device that biases said electrode shield towards said projected position, said biasing member being operable to permit said electrode shield to move towards said retracted position against a biasing force thereof in response to an insertion of the lamp mouthpiece into said lamp mounting opening;

wherein said electrode shield permits said center electrode and said peripheral electrode to be electrically engaged with said center contact element and said peripheral contact element respectively, in said lamp mouthpiece when said electrode shield is moved to said retracted position, while substantially concealing said center electrode and said peripheral electrode when said electrode shield is in said projected position, said electrode carrier comprising a tubular sheath made of an electrically insulating material and accommodating therein said center electrode, said tubular sheath forming a part of said electrode shield, said electrode carrier being integrally formed with said hollow casing.

10. The lamp socket of claim 6, wherein said center electrode and said peripheral electrode are disposed in line with each other in a direction radial to said hollow casing.

11. The lamp socket of claim 7, wherein said electrode carrier is integrally formed with said hallow casing.

12. The lamp socket of claim 7, wherein said center electrode and said peripheral electrode are disposed in line with each other in a direction radial to said hallow casing.

13. The lamp socket according to claim 1, wherein said electrode shield, in said retracted position, is positioned so that at least one of said peripheral electrode and said center electrode is closer to the lamp mounting opening of said hollow casing, than said electrode shield.

14. The lamp socket according to claim 7, wherein said electrode shield, in said retracted position is positioned so that at least one of said peripheral electrode and said center electrode is closer to the lamp mounting opening of said hollow casing, than said electrode shield.

15. The lamp socket according to claim 1, said electrode shield moving from said projected position by linear translation with respect to said hollow casing.

16. The lamp socket according to claim 7, said electrode shield moving from said projected position by linear translation with respect to said hollow casing.

17. The lamp socket according to claim 1, said center electrode and said peripheral electrode being substantially aligned with each other along a lamp mounting direction.

18. The lamp socket according to claim 7, said center electrode and said peripheral electrode being substantially aligned with each other along a lamp mounting direction.

* * * * *

UNITED STATES PATENT AND TRADEMARK OFFICE

CERTIFICATE OF CORRECTION

PATENT NO. : 5,823,806

DATED : October 20, 1998

INVENTOR(S) : Haruo NAGASE et al.

It is certified that error appears in the above-identified patent and that said Letters Patent is hereby corrected as shown below:

[57] ABSTRACT, line 6, change "disposedon" to ---disposed on---.

At column 16, line 52 (claim 4, line 3) of the printed patent, change "hallow" to ---hollow---.

At column 16, line 59 (claim 4, line 10) of the printed patent, change "hallow" to ---hollow ---.

At column 18, line 28 (claim 9, line 38) of the printed patent, change "element respectively," to ---element, respectively,---.

Signed and Sealed this

Eighteenth Day of July, 2000

*Attest:*

*Attesting Officer*

Q. TODD DICKINSON

*Director of Patents and Trademarks*